US012434928B2

(12) United States Patent
Tamaki et al.

(10) Patent No.: US 12,434,928 B2
(45) Date of Patent: Oct. 7, 2025

(54) SHEET FEEDING DEVICE AND IMAGE FORMING APPARATUS INCORPORATING THE SHEET FEEDING DEVICE

(71) Applicants: Sachika Tamaki, Kanagawa (JP); Hidetoshi Kojima, Kanagawa (JP)

(72) Inventors: Sachika Tamaki, Kanagawa (JP); Hidetoshi Kojima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 128 days.

(21) Appl. No.: 18/494,070

(22) Filed: Oct. 25, 2023

(65) Prior Publication Data

US 2024/0174467 A1 May 30, 2024

(30) Foreign Application Priority Data

Nov. 29, 2022 (JP) ..... 2022-190255

(51) Int. Cl.

| | |
|---|---|
| ***B65H 3/12*** | (2006.01) |
| ***B65H 3/48*** | (2006.01) |
| ***B65H 7/02*** | (2006.01) |

(52) U.S. Cl.

CPC ..... *B65H 3/128* (2013.01); *B65H 3/48* (2013.01); *B65H 7/02* (2013.01); *B65H 2406/3662* (2013.01); *B65H 2511/414* (2013.01); *B65H 2513/50* (2013.01); *B65H 2513/512* (2013.01); *B65H 2801/06* (2013.01)

(58) Field of Classification Search

CPC ... B65H 3/08–3/128; B65H 2406/3662; B65H 2406/36625

See application file for complete search history.

(56) References Cited

U.S. PATENT DOCUMENTS

| | | | | |
|---|---|---|---|---|
| 8,074,978 | B2 * | 12/2011 | Takahashi | B65H 3/48 271/97 |
| 10,315,870 | B2 * | 6/2019 | Okutsu | B65H 3/48 |
| 2009/0283958 | A1 | 11/2009 | Takahashi | |
| 2018/0237239 | A1 | 8/2018 | Okutsu et al. | |
| 2023/0159289 | A1 | 5/2023 | Takamiya et al. | |

FOREIGN PATENT DOCUMENTS

| | | | |
|---|---|---|---|
| JP | 2007-331944 | A | 12/2007 |
| JP | 2009-203072 | A | 9/2009 |
| JP | 2009-274837 | A | 11/2009 |

* cited by examiner

*Primary Examiner* — Jeremy R Severson
(74) *Attorney, Agent, or Firm* — IPUSA, PLLC

(57) ABSTRACT

A sheet feeding device includes an air blower and circuitry. The air blower includes a first suction fan, and a second suction fan serially coupled to the first suction fan. The circuitry is to stop the first suction fan at a first timing, and stop the second suction fan at a second timing different from the first timing. An image forming apparatus includes the sheet feeding device.

8 Claims, 12 Drawing Sheets

SHEET FEEDING DEVICE AND IMAGE FORMING APPARATUS INCORPORATING THE SHEET FEEDING DEVICE

CROSS-REFERENCE TO RELATED APPLICATION

This patent application is based on and claims priority pursuant to 35 U.S.C. § 119(a) to Japanese Patent Application No. 2022-190255, filed on Nov. 29, 2022, in the Japan Patent Office, the entire disclosure of which is hereby incorporated by reference herein.

BACKGROUND

Technical Field

Embodiments of the present disclosure relate to a sheet feeding device and an image forming apparatus incorporating the sheet feeding device.

Background Art

Various sheet feeding devices are disclosed that uses a fan unit in which multiple blower fans are serially aligned so that a sheet of sheets stacked on a tray is attracted and conveyed.

However, some blower (suction) fans can be operated again only after the blower fans come to a complete stop. In the sheet feeding device including such a blower fan, the subsequent sheet cannot be fed until the blower fan is completely stopped, and the productivity of the sheet feeding device may be deteriorated.

SUMMARY

Embodiments of the present disclosure described herein provide a novel sheet feeding device including an air blower and circuitry. The air blower includes a first suction fan, and a second suction fan serially coupled to the first suction fan. The circuitry is to stop the first suction fan at a first timing, and stop the second suction fan at a second timing different from the first timing.

Further, embodiments of the present disclosure described herein provide an image forming apparatus including the above-described sheet feeding device.

BRIEF DESCRIPTION OF THE SEVERAL VIEWS OF THE DRAWINGS

Exemplary embodiments of this disclosure will be described in detail based on the following figures, wherein.

Figure 1:
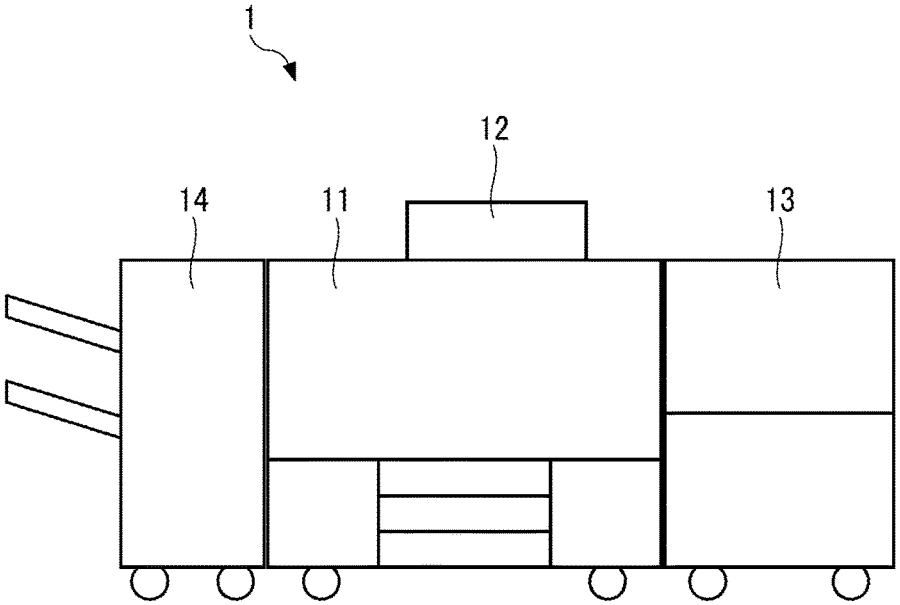
FIG. 1 is a diagram illustrating a schematic configuration of an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Embodiments of the present disclosure are described below in detail with reference to the drawings. It is to be understood that an identical or similar reference character is given to identical or corresponding parts throughout the drawings, and redundant descriptions are omitted or simplified below.

With reference to drawings, descriptions are given below of embodiments of the present disclosure. In the drawings for illustrating embodiments of the present disclosure, elements, or components identical or similar in function or shape are given identical reference numerals as far as distinguishable, and redundant descriptions are omitted.

Hereinafter, embodiments of the present disclosure are described with reference to the drawings. In each drawing, the same configuration shares the same reference numeral, and the overlapped description is omitted.

First Embodiment Overall Configuration of Image Forming Apparatus 1

A description is given of an overall configuration of an image forming apparatus 1 according to a first embodiment of the present disclosure, with reference to FIG. 1.

FIG. 1 is a diagram illustrating a schematic configuration of an image forming apparatus according to a first embodiment of the present disclosure.

As illustrated in FIG. 1, the image forming apparatus 1 is an electrophotographic color image forming apparatus and includes an image forming device 11, an image reading device 12, a sheet feeding device 13, and a sheet ejection device 14. However, the image forming method performed in the image forming apparatus 1 is not limited to an electrophotographic image forming method and may employ an inkjet image forming method. The sheet feeding device 13 serves as a sheet feeding device.

The image forming device 11 includes, for example, a laser scanner unit, photoconductor drums, developing units, and a fixing unit. The image reading device 12 reads an image of an original document and outputs a read image signal to the laser scanner unit of the image forming device 11.

The laser scanner unit irradiates the photoconductor drums with laser light based on the image signals output from the image reading device 12. As a result, electrostatic latent images are formed on the respective surfaces of the photoconductor drums. The electrostatic latent images formed on the photoconductor drums are developed with toners supplied by the developing units into respective visible toner images.

On the other hand, the sheet feeding device 13 feeds a sheet such as a paper toward the photoconductor drums. As a result, the toner images formed on the photoconductor drums are sequentially transferred onto the sheet to be overlaid one after another to form a composite toner image. The fixing unit applies heat and pressure to the sheet on which the toner image is formed and fixes the toner image to the sheet. Eventually, the sheet is conveyed toward the sheet ejection device 14. The sheet ejection device 14 ejects the sheet conveyed from the fixing unit.

Sheet Feeding Device

A detailed description is given of the sheet feeding device 13 according to the present embodiment, with reference to FIGS. 2 to 5.

Figure 2:
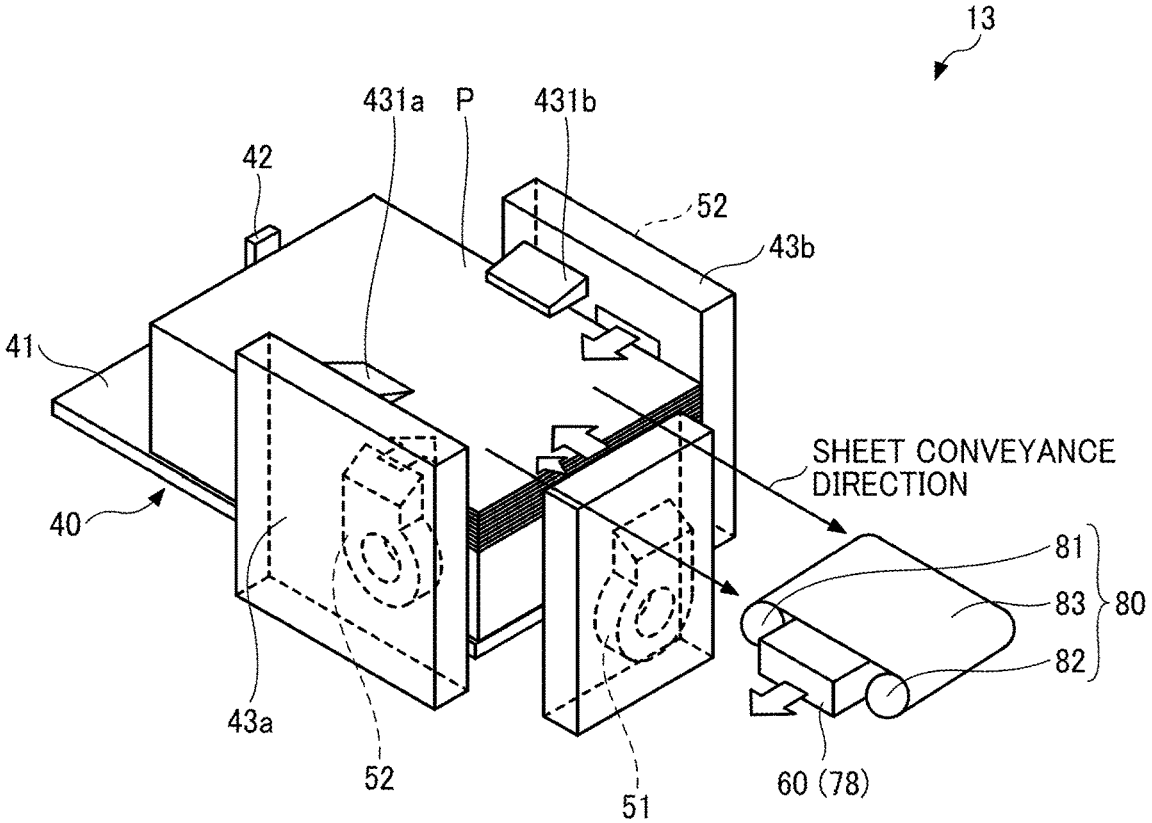
FIG. 2 is a perspective view of a sheet feeding device according to a first embodiment of the present disclosure, featuring an interior of the sheet feeding device.

FIG. 2 is a perspective view of the interior of the sheet feeding device 13 according to the present embodiment.

Figure 3:
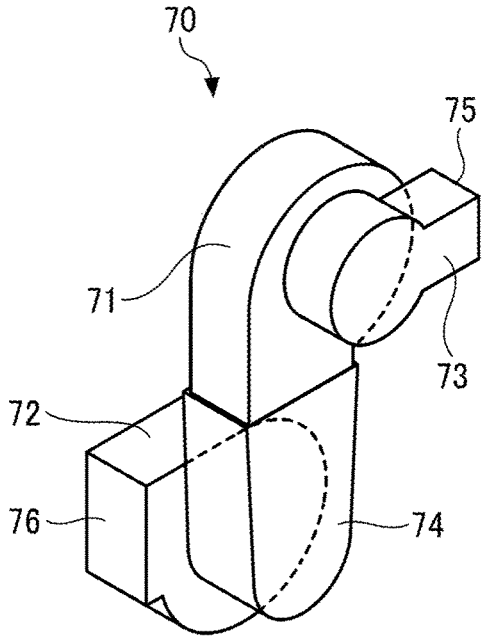
FIG. 3 is a perspective view of a fan unit of the sheet feeding device according to the first embodiment of the present disclosure.

FIG. 3 is a perspective view of a fan unit 70 of the sheet feeding device 13 according to the present embodiment.

Figure 4A:
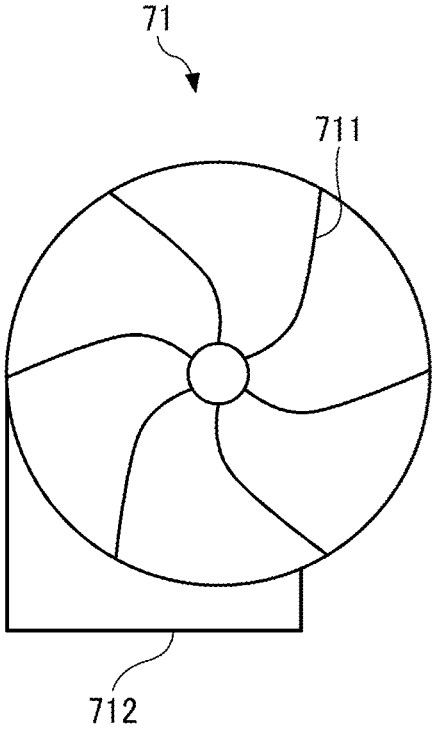
FIG. 4A is a diagram illustrating a configuration of a first suction fan of the fan unit according to the first embodiment.

FIG. 4A is a diagram illustrating a configuration of a first suction fan 71 of the fan unit 70 according to the present embodiment.

Figure 4B:
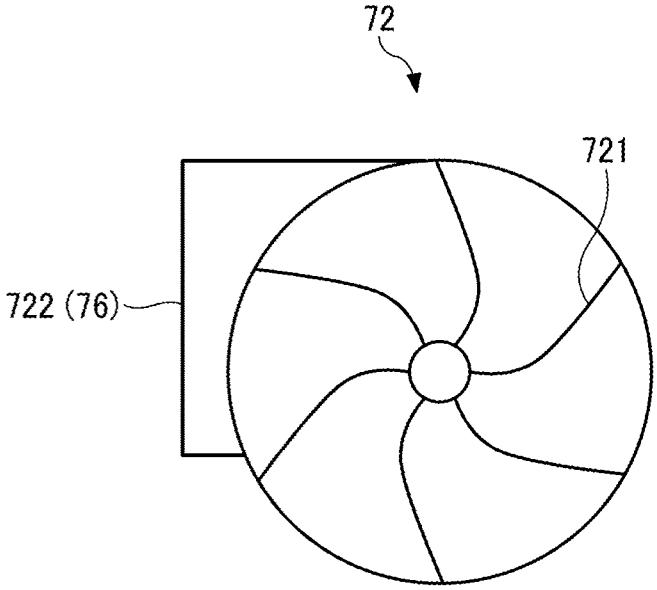
FIG. 4B is a diagram illustrating a configuration of a second suction fan of the fan unit according to the first embodiment.

FIG. 4B is a diagram illustrating a configuration of a second suction fan 72 of the fan unit 70 according to the present embodiment.

Figure 5:
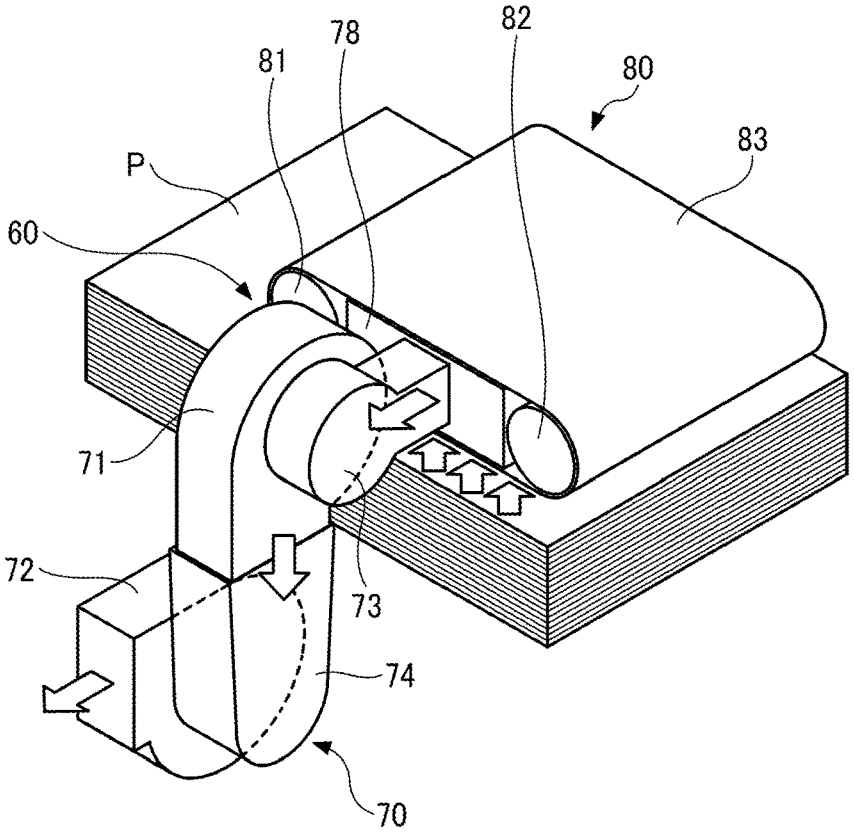
FIG. 5 is a perspective view of a suction mechanism, the fan unit, and a conveyance mechanism according to the first embodiment of the present disclosure, in a state where the suction mechanism sucks a sheet.

FIG. 5 is a perspective view of a suction mechanism 60, the fan unit 70, and a conveyance mechanism 80 according to the present embodiment, in a state where the suction mechanism 60 sucks a sheet.

Figure 6:
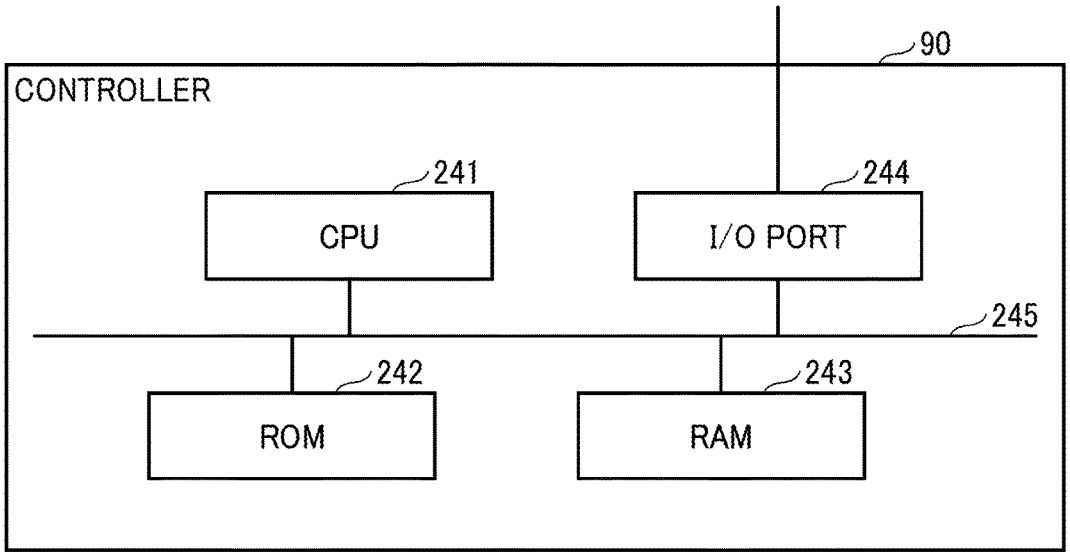
FIG. 6 is a block diagram illustrating a hardware configuration of a controller according to the first embodiment of the present disclosure.

As illustrated in FIGS. 2 and 3, the sheet feeding device 13 includes a sheet tray 40, a front air blower 51, a side air blower 52, the suction mechanism 60, the conveyance mechanism 80, and a controller 90 (see FIG. 6). The suction mechanism 60 serves as an air blower. The conveyance mechanism 80 serves as a conveyor. The controller 90 serves as a controller.

The sheet tray 40 includes a sheet stacking table 41, an end fence 42, and side fences 43*a* and 43*b* to accommodate a sheet bundle P to be fed. The sheet stacking table 41 stacks the sheet bundle P. The end fence 42 is disposed, for example, on the side of the trailing end of a sheet in the sheet conveyance direction. The side fences 43*a* and 43*b* are disposed at both sides of the sheet tray 40 in a direction orthogonal to the sheet conveyance direction. It is preferable that the sheet stacking table 41 is disposed to be movable in the vertical direction of the sheet tray 40. The side fences 43*a* and 43*b* may include sheet pressers 431*a* and 431*b* each protruding toward the inside of the sheet tray 40.

The front air blower 51 is disposed on the side of the leading end of a sheet in the sheet conveyance direction. The front air blower 51 blows air toward the sheet bundle P accommodated in the sheet tray 40 to lift up the upper sheets including an uppermost sheet placed on the upper part of the sheet bundle P. The front air blower 51 blows air to separate the lifted upper sheets one by one. The front air blower 51 serves as a blower fan.

The side air blower 52 is disposed on both sides of, for example, the side fences 43*a* and 43*b* to blow air from both sides of the sheet bundle P. The side air blower 52 serves as a blower fan. The front air blower 51 and the side air blower 52 blow air to separate the lifted upper sheets one by one.

The suction mechanism 60 includes the fan unit 70 and a suction chamber 78. The conveyance mechanism 80 includes a drive roller 81, a driven roller 82, and a suction belt 83 that is an endless belt wound around the drive roller 81 and the driven roller 82. The suction chamber 78 is positioned in a space surrounded by the suction belt 83.

As illustrated in FIG. 3, the fan unit 70 includes a first suction fan 71, a second suction fan 72, a first duct 73 coupled to the first suction fan 71, and a second duct 74 coupled to the second suction fan 72. The first suction fan 71 and the second suction fan 72 are coupled to each other in a serial manner via the second duct 74. As described above, the first suction fan 71 and the second suction fan 72 are coupled to each other in a serial manner. Thus, a negative pressure greater than a pressure of a single fan can be generated.

The interiors of the first duct 73, the first suction fan 71, the second duct 74, and the second suction fan 72 communicate with each other to form a flow passage of air generated by driving of the first suction fan 71 and the second suction fan 72.

As illustrated in FIG. 4A, the first suction fan 71 is a blower (suction) fan having a rotor blade 711 including multiple blades. The rotor blade 711 rotates as a motor coupled to the rotor blade 711 drives. Due to such a configuration, air flows into the first suction fan 71 from the first duct 73. The air flowing in the first suction fan 71 is exhausted from an exhaust opening 712 to flow toward the second duct 74.

As illustrated in FIG. 4B, the second suction fan 72 is a blower (suction) fan having a rotor blade 721 including multiple blades. The rotor blade 721 rotates as a motor coupled to the rotor blade 721 drives. Due to such a configuration, air flows into the second suction fan 72 from the second duct 74. The air flowing in the second suction fan 72 is exhausted from an exhaust opening 722.

The exhaust opening 722 of the second suction fan 72 corresponds to an exhaust port of an air flow passage in the fan unit 70.

The fan unit 70 according to the present embodiment includes two suction fans, i.e., the first suction fan 71 and the second suction fan 72. However, the number of suction fans may be three or more. Further, in the present embodiment, the first suction fan 71 is disposed at a position closer to the suction chamber 78 than the second suction fan 72. However, the relation of the positions of the first suction fan 71 and the second suction fan 72 may be opposite.

As illustrated in FIG. 5, the suction chamber 78 is coupled to the fan unit 70. The interior of the suction chamber 78 is set to a negative pressure by driving the first suction fan 71 and the second suction fan 72 of the fan unit 70. On the other hand, the suction belt 83 has multiple holes formed through in the suction belt 83. As a result, air blown from the front air blower 51 and the side air blower 52 causes the lifted and separated sheet to be attracted to the suction belt 83. Further, the drive roller 81 is driven to convey the sheet attracted to the suction belt 83 in the sheet conveyance direction.

Hardware Configuration of Controller

A description is given of a hardware configuration of a controller 90 according to the present embodiment, with reference to FIG. 6.

FIG. 6 is a block diagram illustrating the hardware configuration of the controller 90 according to the first embodiment of the present disclosure.

As illustrated in FIG. 6, the controller 90 includes a central processing unit (CPU) 241, a read only memory (ROM) 242, a random access memory (RAM) 243, and an input/output (I/O) port 244.

The CPU 241 is an operating unit that executes programs stored in the ROM 242 to execute, for example, processing of sequence, selection, and repetition. The ROM 242 is a nonvolatile storage device that stores programs and data executed by the CPU 241. The RAM 243 is a memory that is used as, for example, a work area for the CPU 241. The I/O port 244 is an interface for inputting and outputting of various signals. The bus line 245 is, e.g., an address bus or a data bus to electrically connect the components such as the CPU 241. The controller 90 may not have the above-described configuration.

Functional Configuration of Controller

Figure 7:
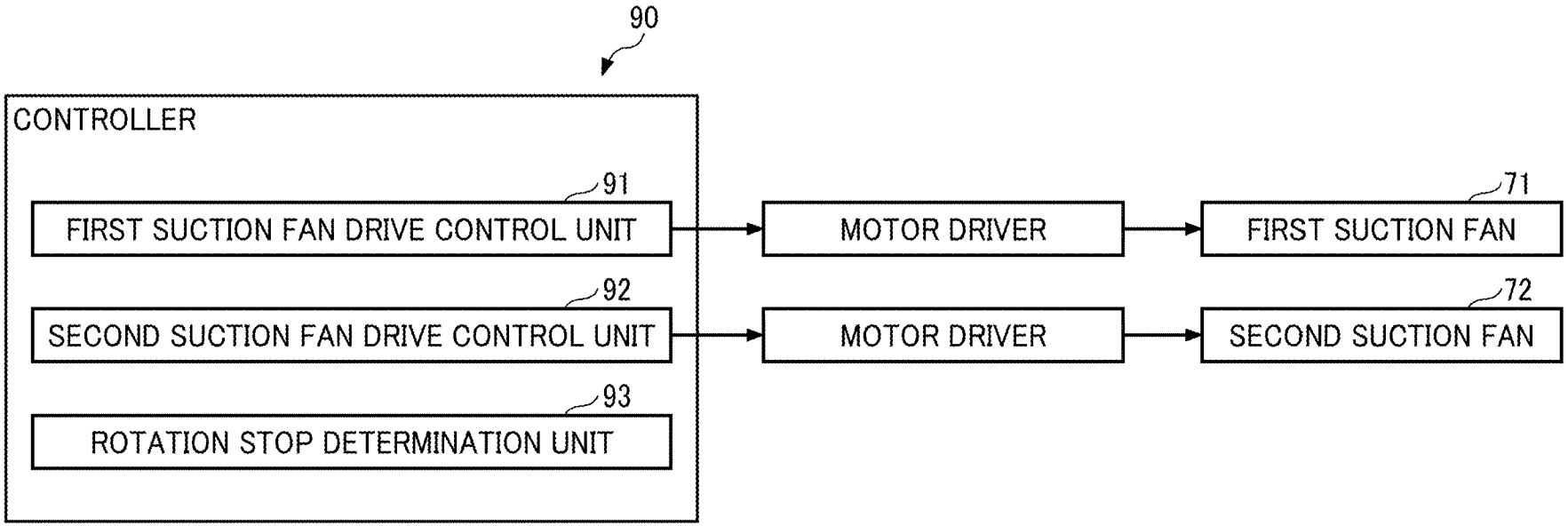
FIG. 7 is a block diagram illustrating a functional configuration of the controller according to the first embodiment of the present disclosure.
Figure 8:
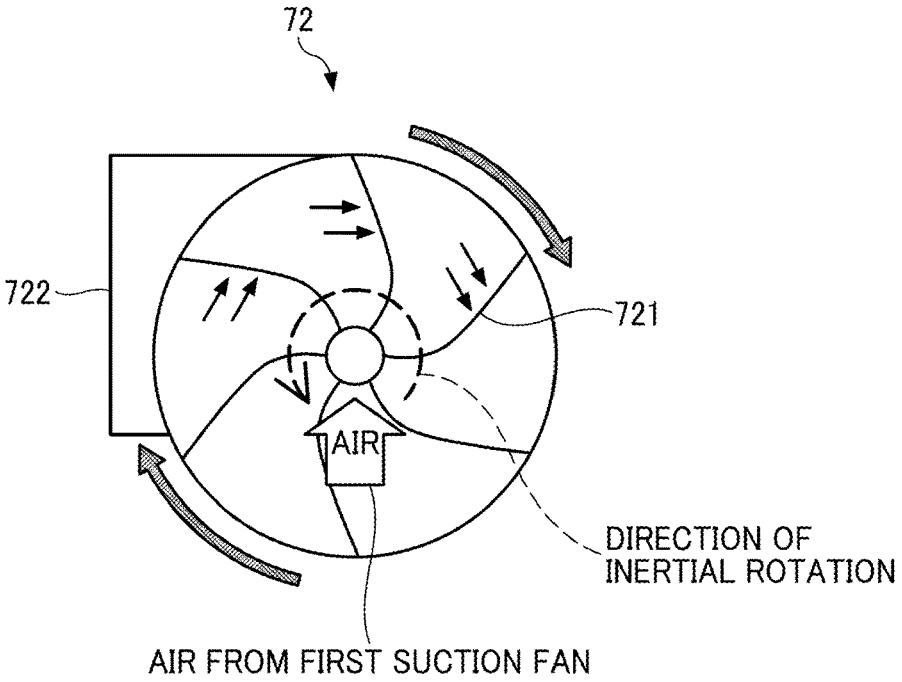
FIG. 8 is a schematic diagram illustrating a second suction fan in a state where air from a first suction fan is blown to rotor blades of the second suction fan according to the first embodiment of the present disclosure.

A described now is given of a functional configuration of the controller 90 according to the present embodiment, with reference to FIGS. 7 and 8.

FIG. 7 is a block diagram illustrating a functional configuration of the controller 90 according to the first embodiment of the present disclosure.

FIG. 8 is a schematic diagram illustrating the second suction fan 72 in a state where air from the first suction fan 71 is blown to the rotor blade 721 of the second suction fan 72 performing an inertial rotation.

As illustrated in FIG. 7, the controller 90 according to the present embodiment includes a first suction fan drive control unit 91, a second suction fan drive control unit 92, and a rotation stop determination unit 93. The functions of the first suction fan drive control unit 91, the second suction fan drive control unit 92, and the rotation stop determination unit 93 are implemented by executing a predetermined program by, for example, the CPU 241.

Specifically, the first suction fan drive control unit 91 outputs a control signal to a motor driver that drives a motor of the first suction fan 71 to in instruct a start or stop of the driving of the motor. Further, the second suction fan drive control unit 92 outputs a control signal to a motor driver that drives a motor of the second suction fan 72 to instruct a start or stop of the driving of the motor. The control signal that indicates the driving of a motor may be referred to as a "drive start instruction signal". The control signal that indicates the stop of the driving of the motor may be referred to as a "drive stop instruction signal".

Although not particularly limited, the drive instruction signals from the first suction fan drive control unit 91 and the second suction fan drive control unit 92 are output in accordance with, for example, a print job signal input from an information terminal of a user to the image forming apparatus 1. Further, the drive stop instruction signals from the first suction fan drive control unit 91 and the second suction fan drive control unit 92 are output in response to completion of printing on a sheet in accordance with, for example, a print job signal.

The first suction fan 71 according to the present embodiment can be driven by the subsequent drive start instruction signal without waiting for a complete stop of the rotor blade 711 after the start of the stopping operation based on the drive stop instruction signal.

On the other hand, the second suction fan 72 cannot be driven during the inertial rotation of the rotor blade 721 after the start of the stopping operation based on the drive stop instruction signal. In other words, if the rotor blade 721 of the second suction fan 72 does not completely stop, a drive start instruction signal in accordance with the subsequent print job signal cannot be received. The "stopping operation" of the first suction fan 71 refers to an operation of the first suction fan 71 after the drive stop instruction signal is output from the first suction fan drive control unit 91 to the motor driver.

The controller 90 according to the present embodiment sets a time difference between the stop timing of the first suction fan 71 and the stop timing of the second suction fan 72 at the time of stop operation control of the first suction fan 71 and the second suction fan 72 (i.e., at the time of outputting a drive stop instruction signal to each motor driver). Specifically, the first suction fan drive control unit 91 outputs the drive stop instruction signal after a predetermined period of time has elapsed from a time when the second suction fan drive control unit 92 has output the drive stop instruction signal. As a result, the controller 90 controls so that the first suction fan 71 and the second suction fan 72 stop at timings relatively different from each other.

The second suction fan drive control unit 92 outputs the drive stop instruction signal to the motor driver of the second suction fan 72, and the second suction fan 72 starts the stopping operation. At this time, the second suction fan 72 rotates by inertia. The "stopping operation" of the second suction fan 72 refers to an operation of the second suction fan 72 after the drive stop instruction signal is output from the second suction fan drive control unit 92 to the motor driver.

On the other hand, the first suction fan drive control unit 91 does not output the drive stop instruction signal, and cause the first suction fan 71 to continue to drive. As a result, as illustrated in FIG. 8, air is blown from the first suction fan 71 to the rotor blade 721 of the second suction fan 72 that rotates by inertia.

As a result, the force acts on the rotor blade 721 in a direction opposite to the direction of inertial rotation, and the time until the rotor blade 721 completely rotates can be shortened.

Subsequently, the first suction fan drive control unit 91 outputs the drive stop instruction signal to the motor driver of the first suction fan 71, and cause the first suction fan 71 to stop driving.

The rotation stop determination unit 93 determines that the rotation of the rotor blade 711 of the first suction fan 71 and the rotation of the rotor blade 721 of the second suction fan 72 completely stop after a predetermined set time has elapsed. However, the present disclosure is not limited to the above-described operation. For example, the rotation stop determination unit 93 may determine a complete stop of rotation of each rotor blade based on a detection signal from a rotation number detector (e.g., a rotary encoder) to detect the number of rotations of the rotor blade 711 of the first suction fan 71 and the number of rotations of the rotor blade 721 of the second suction fan 72.

The respective functions executed by the controller 90 according to the above-described embodiment can be implemented by one or more processing circuits. The term "processing circuit or circuitry" in the present specification includes a programmed processor to execute each function by software, such as the CPU 241 implemented by an electronic circuit, and devices, such as an application specific integrated circuit (ASIC), a digital signal processor (DSP), a field programmable gate array (FPGA), and conventional circuit components arranged to perform the recited functions.

Operations

Figure 9:
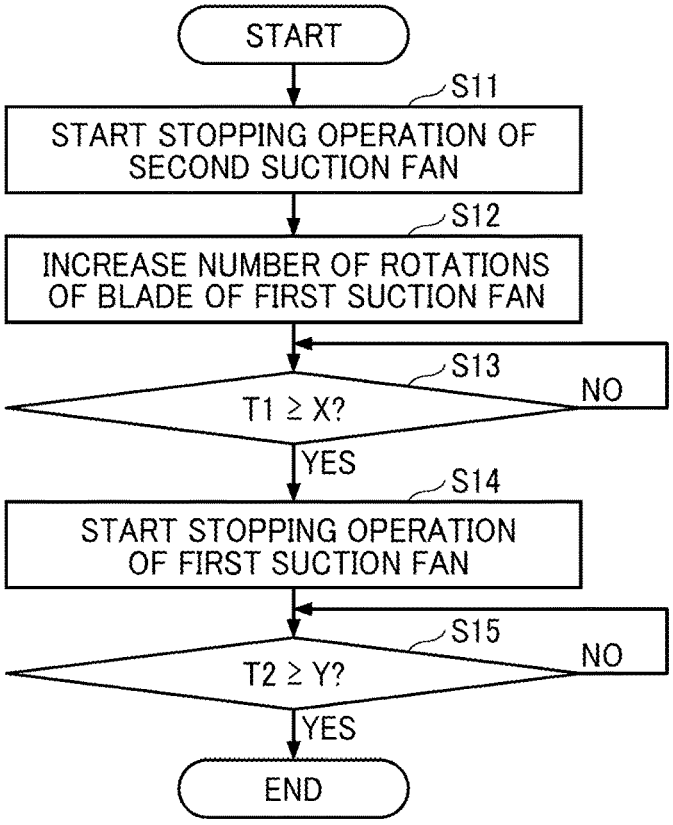
FIG. 9 is a flowchart of a flow of operations of the fan unit according to the first embodiment of the present disclosure.

A description is now given of the operations of the fan unit 70 according to the present embodiment, with reference to FIG. 9.

FIG. 9 is a flowchart of a flow of operations of the fan unit 70 according to the first embodiment of the present disclosure.

Initially, the second suction fan drive control unit 92 of the controller 90 outputs a drive stop instruction signal to the motor driver of the second suction fan 72 (step S11). In response to receipt of the drive stop instruction signal, the second suction fan 72 starts the stopping operation. However, the rotor blade 721 of the second suction fan 72 does not completely stop quickly and continues the rotation by inertia.

Then, the first suction fan drive control unit 91 of the controller 90 outputs a control signal to increase the number of rotations of the rotor blade 711 of the first suction fan 71 from the number of rotations during the normal control period, to the motor driver of the first suction fan 71 (step S12). By so doing, the number of rotations of the rotor blade 711 of the first suction fan 71 increases. As a result, the air blow amount to the second suction fan 72 rotating by inertia increases and the time until the rotor blade 721 completely stops can be reduced. The "normal control period" refers to a period other than a period (of the stopping operation) that controls the stop of the operations of the first suction fan 71 and the second suction fan 72.

Subsequently, the rotation stop determination unit 93 of the controller 90 determines whether the time T1 since the output of the drive stop instruction signal to the second suction fan 72 has elapsed the given time X (for example, 8 seconds) (step S13).

When the rotation stop determination unit 93 determines that the given time X has not yet elapsed since the output of the drive stop instruction signal to the second suction fan 72 (NO in step S13), step S13 is repeated until the given time X elapses. When the rotation stop determination unit 93 determines that the given time X has elapsed since the output of the drive stop instruction signal to the second suction fan 72 (YES in step S13), the first suction fan drive control unit 91 outputs the drive stop instruction signal to the motor driver of the first suction fan 71 (step S14).

Then, the rotation stop determination unit 93 of the controller 90 determines whether the time T2 since the output of the drive stop instruction signal to the first suction fan 71 has elapsed the given time Y (for example, 14 seconds) (step S15). When the rotation stop determination unit 93 determines that the given time Y has not yet elapsed since the output of the drive stop instruction signal to the first suction fan 71 (NO in step S15), step S15 is repeated until the given time Y elapses. When the rotation stop determination unit 93 determines that the given time Y has elapsed since the output of the drive stop instruction signal to the first suction fan 71 (YES in step S15), the first suction fan 71 and the second suction fan 72 completely stop.

Modification 1 of First Embodiment

Configuration

Figure 10:
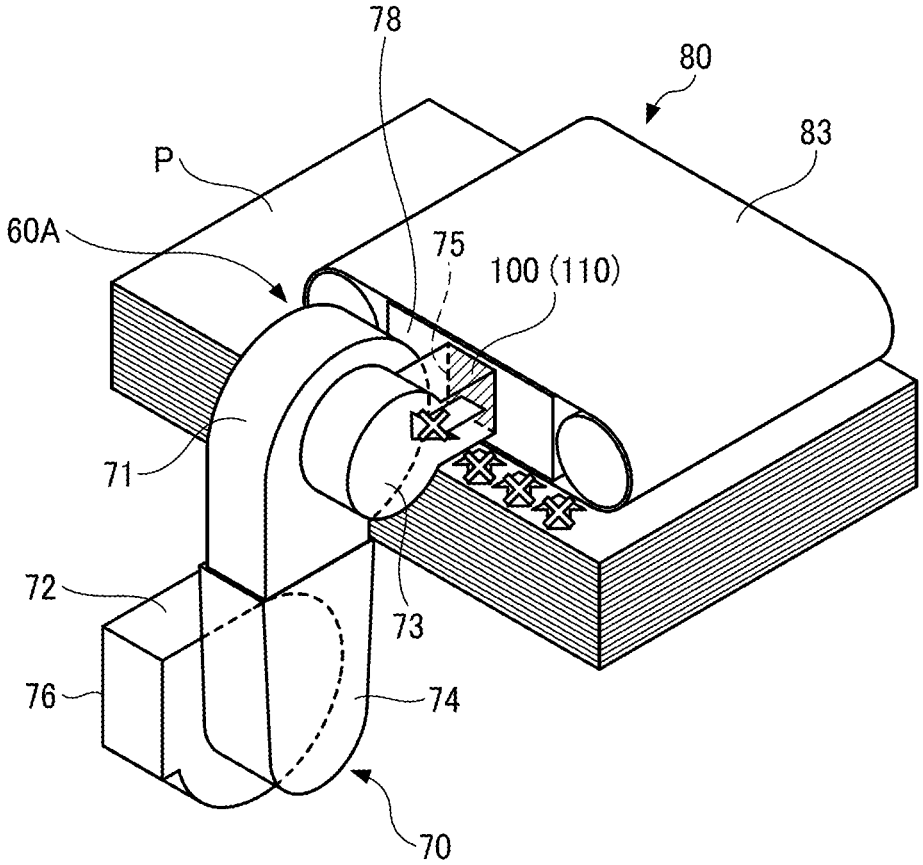
FIG. 10 is a perspective view of the suction mechanism according to Modification 1 of the first embodiment of the present disclosure.

A description is now given of a configuration of a suction mechanism according to Modification 1 of the first embodiment of the present disclosure, with reference to FIG. 10.

FIG. 10 is a perspective view of a suction mechanism 60A according to Modification 1 of the first embodiment of the present disclosure.

In the following description, components that are the same as or similar to those in the first embodiment may be denoted by the same reference numerals and the description may be omitted.

As illustrated in FIG. 10, the suction mechanism 60A according to Modification 1 includes a shutter mechanism 100 that opens and closes the air flow passage of air formed in the fan unit 70 in addition to the fan unit 70 and the suction chamber 78. The shutter mechanism 100 illustrated in FIG. 10 opens and closes a suction port 75 of the air flow passage in the first duct 73. The shutter mechanism 100 serves as a shutter.

The shutter mechanism 100 includes a shutter 110 that opens and closes the suction port 75, and a drive unit of the shutter 110 (e.g., an actuator such as a solenoid). The drive unit of the shutter 110 may also be referred to as a "shutter driver".

The shutter 110 of the shutter mechanism 100 may close the whole suction port 75. Due to such a configuration, the first duct 73 and the suction chamber 78 are blocked from each other. As a result, even if the first suction fan 71 continues driving to completely stop the second suction fan 72, a sheet is prevented from being sucked by the suction mechanism 60.

The shutter 110 may close part of the suction port 75. Due to such a configuration, the air flow amount (i.e., the amount of air blow) of air sucked from the suction chamber 78 to the first duct 73 can be adjusted. As a result, the air suction force of a sheet in the suction mechanism 60A can be adjusted. In adjustment of the air flow amount of air sucked from the suction chamber 78 to the first duct 73, the shutter 110 may open and close part of an exhaust port 76 of the fan unit 70. The shutter 110 may also open and close part of a port other than the suction port 75 and the exhaust port 76, in the air flow passage of air formed in the fan unit 70.

Controller

Figure 11:
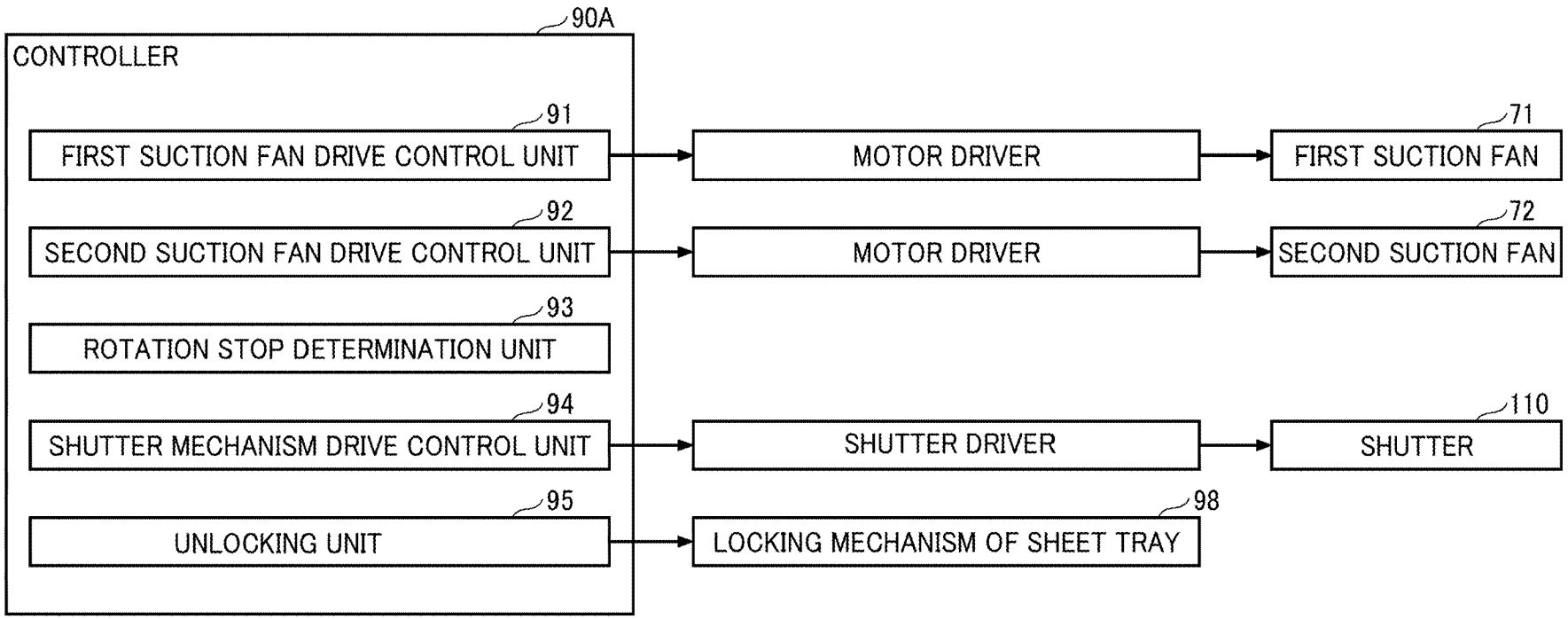
FIG. 11 is a block diagram illustrating a functional configuration of the controller according to Modification 1 of the first embodiment of the present disclosure.

A description is now given of a functional configuration of a controller 90A according to Modification 1 of the first embodiment, with reference to FIG. 11.

FIG. 11 is a block diagram illustrating a functional configuration of the controller 90A according to Modification 1 of the first embodiment of the present disclosure.

As illustrated in FIG. 11, the controller 90A according to Modification 1 further includes a shutter mechanism drive control unit 94. Specifically, the shutter mechanism drive control unit 94 outputs a drive signal to the shutter driver to control the operations of the shutter 110. The function of the shutter mechanism drive control unit 94 is implemented by executing the predetermined program by, for example, the CPU 241.

The sheet tray 40 may further include a lock mechanism 98 that locks the sheet tray 40. At this time, the controller 90A may further include an unlocking unit 95 that unlocks the lock mechanism 98. The function of the unlocking unit 95 is also implemented by executing the predetermined program by, for example, the CPU 241.

Operations

Figure 12:
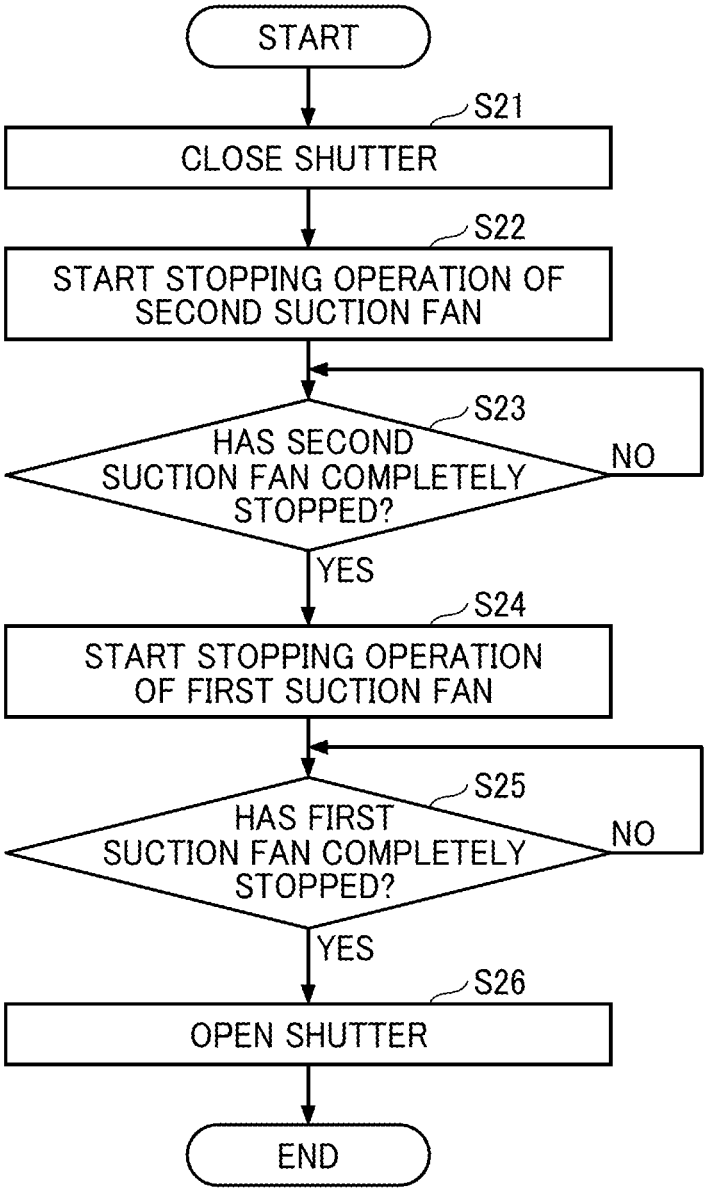
FIG. 12 is a flowchart of a flow of operations of a shutter mechanism according to Modification 1 of the first embodiment of the present disclosure.

A description is now given of the operations of the shutter mechanism 100 according to Modification 1 of the first embodiment, with reference to FIG. 12.

FIG. 12 is a flowchart of a flow of the operations of the shutter mechanism 100 according to Modification 1 of the first embodiment of the present disclosure.

Initially, in response to the end of the print job, the shutter mechanism drive control unit 94 of the controller 90A outputs a control signal to the shutter driver so that the shutter 110 operates to close the suction port 75 of the air flow passage of air formed in the fan unit 70 (step S21). This configuration can prevent generation of a negative pressure in the suction chamber 78 due to the operations of the first suction fan 71 and the second suction fan 72. In other words, after completion of the print job, the sheet is prevented from being sucked into the suction mechanism 60A.

Then, the second suction fan drive control unit 92 of the controller 90A outputs a drive stop instruction signal to the motor driver of the second suction fan 72 (step S22). In response to receipt of the drive stop instruction signal, the second suction fan 72 starts the stopping operation. However, the rotor blade 721 of the second suction fan 72 does not completely stop quickly and continues the rotation by inertia.

By contrast, the first suction fan 71 continues driving. Due to the continuous driving of the first suction fan 71, air generated due to the rotation of the rotor blade 711 of the first suction fan 71 is blown to the rotor blade 721 of the second suction fan 72 that continues rotating by inertia, and the force is applied to the rotor blade 721 in a direction opposite to the direction of inertial rotation.

Subsequently, the rotation stop determination unit 93 of the controller 90A determines whether the rotor blade 721 of the second suction fan 72 has completely stopped (step S23). The method of determining the complete stop of the rotor blade 721 may be the same as or similar to the method of determining in the first embodiment.

When the rotation stop determination unit 93 determines that the rotor blade 721 of the second suction fan 72 has not completely stopped (NO in step S23), step S23 is repeated until the rotor blade 721 of the second suction fan 72 completely stops. When the rotation stop determination unit 93 determines that the rotor blade 721 of the second suction fan 72 has completely stopped (YES in step S23), the first suction fan drive control unit 91 of the controller 90A outputs a drive stop instruction signal to the motor driver of the first suction fan 71 (step S24).

Subsequently, the rotation stop determination unit 93 of the controller 90A determines whether the rotor blade 711 of the first suction fan 71 has completely stopped (step S25). The method of determining the complete stop of the rotor blade 711 may be the same as or similar to the method of determining in the first embodiment.

When the rotation stop determination unit 93 determines that the rotor blade 711 of the first suction fan 71 has not completely stopped (NO in step S25), step S25 is repeated until the rotor blade 711 of the first suction fan 71 completely stops. When the rotation stop determination unit 93 determines that the rotor blade 711 of the first suction fan 71 has completely stopped (YES in step S25), the shutter mechanism drive control unit 94 of the controller 90A outputs a control signal to the shutter driver so that the shutter 110 operates to open the suction port 75 of the air flow passage of air formed in the fan unit 70 (step S26). Due to such a configuration, the suction port 75 opens, so that the first duct 73 and the suction chamber 78 communicate with each other again. As a result, after the subsequent print job signal is input, the first suction fan 71 and the second suction fan 72 are driven to promptly apply a negative pressure in the suction chamber 78. In other words, a sheet is promptly fed.

Figure 13:
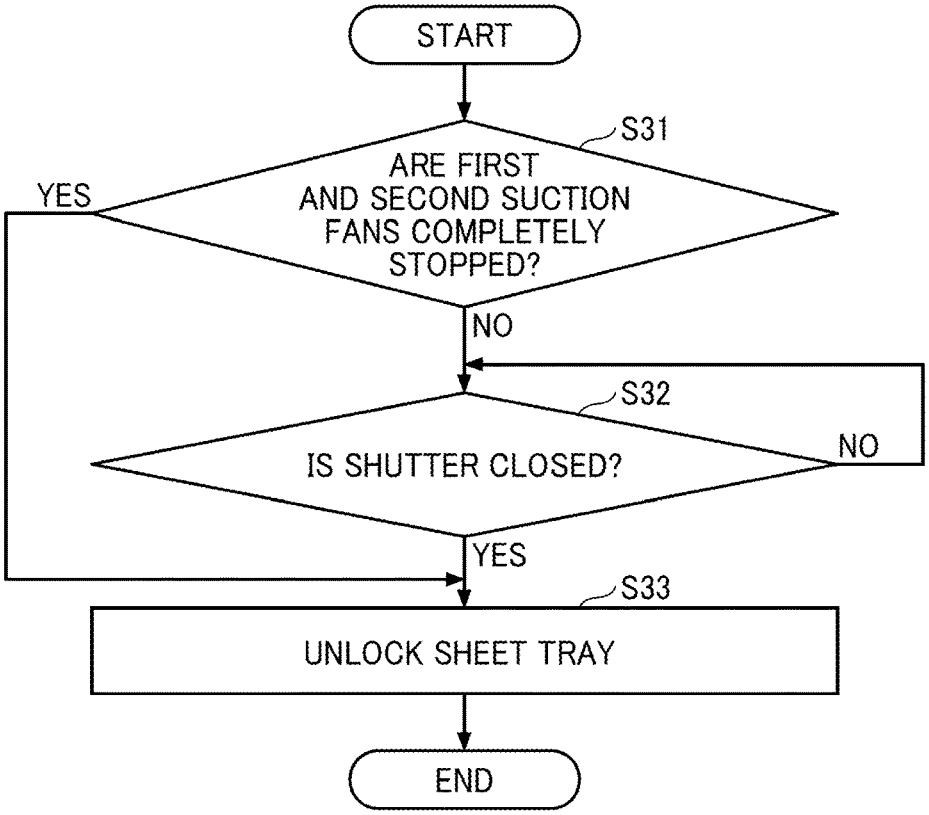
FIG. 13 is a flowchart of a flow of operations performed when a sheet tray according to Modification 1 of the first embodiment of the present disclosure is unlocked.

A description is given of the operations performed when a sheet tray 40 according to Modification 1 is unlocked, with reference to FIG. 13.

FIG. 13 is a flowchart of a flow of operations performed when the sheet tray 40 according to Modification 1 of the first embodiment of the present disclosure is unlocked.

Initially, the rotation stop determination unit 93 determines whether the rotor blade 711 of the first suction fan 71 and the rotor blade 721 of the second suction fan 72 are completely stopped rotating (step S31). The method of determining the complete stop of the rotor blades 711 and 721 by the rotation stop determination unit 93 may be the same as or similar to the method of determining in the first embodiment.

When the rotor blade 711 of the first suction fan 71 and the rotor blade 721 of the second suction fan 72 are completely stopped rotating (YES in step S31), the unlocking unit 95 of the controller 90A outputs a control signal to unlock the sheet tray 40, to the lock mechanism 98 of the sheet tray 40 (step S33). As a result, the sheet tray 40 is unlocked so that the sheet tray 40 can be pulled out from the sheet feeding device 13.

By contrast, when the rotor blade 711 of the first suction fan 71 and the rotor blade 721 of the second suction fan 72 are not completely stopped rotating (NO in step S31), the controller 90A determines whether the shutter 110 is closed to close the suction port 75 (step S32). The method of determining whether the shutter 110 is closed is not particularly limited. For example, whether the shutter 110 is closed is determined by employing the method of using a detection signal from, for example, an optical sensor.

When the controller 90A determines that the shutter 110 is closed to close the suction port 75 (YES in step S32), the unlocking unit 95 of the controller 90A outputs a control signal to unlock the sheet tray 40, to the lock mechanism 98 of the sheet tray 40 (step S33).

According to this operation, even while the first suction fan 71 and the second suction fan 72 are rotating, the first duct 73 and the suction chamber 78 are blocked. Due to such a configuration, the sheet supplied to the sheet tray 40 can be prevented from, for example, being carelessly sucked to the suction belt 83. As a result, without waiting for a complete stop of the rotor blade 711 of the first suction fan 71 and the rotor blade 721 of the second suction fan 72, the sheet tray 40 is pulled out to supply sheets.

When after outputting the control signal to unlock the sheet tray 40, the controller 90A may cause the operation unit for executing various functions of the image forming apparatus 1 to display a message indicating that the sheet tray 40 is unlocked.

Modification 2 of First Embodiment

Configuration

Figure 14:
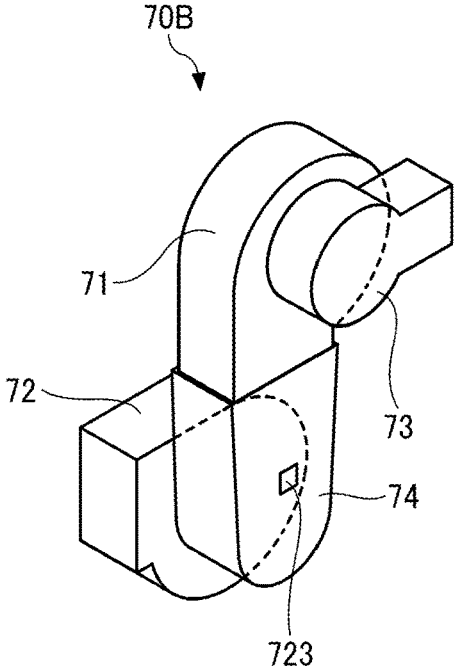
FIG. 14 is a perspective view of the fan unit according to Modification 2 of the first embodiment of the present disclosure.

A description is now given of a configuration of a fan unit according to Modification 2 of the first embodiment, with reference to FIG. 14.

FIG. 14 is a perspective view of a fan unit 70B according to Modification 2 of the first embodiment of the present disclosure.

In the following description, components that are the same as or similar to the components in the first embodiment and Modification 1 of the first embodiment may be denoted by the same reference numerals and the description may be omitted.

As illustrated in FIG. 14, the fan unit 70B according to Modification 2 further includes, for example, a rotary encoder 723 to detect the number of rotations of the rotor blade 721 of the second suction fan 72. The rotary encoder 723 serves as a rotation number detector.

Controller

Figure 15:
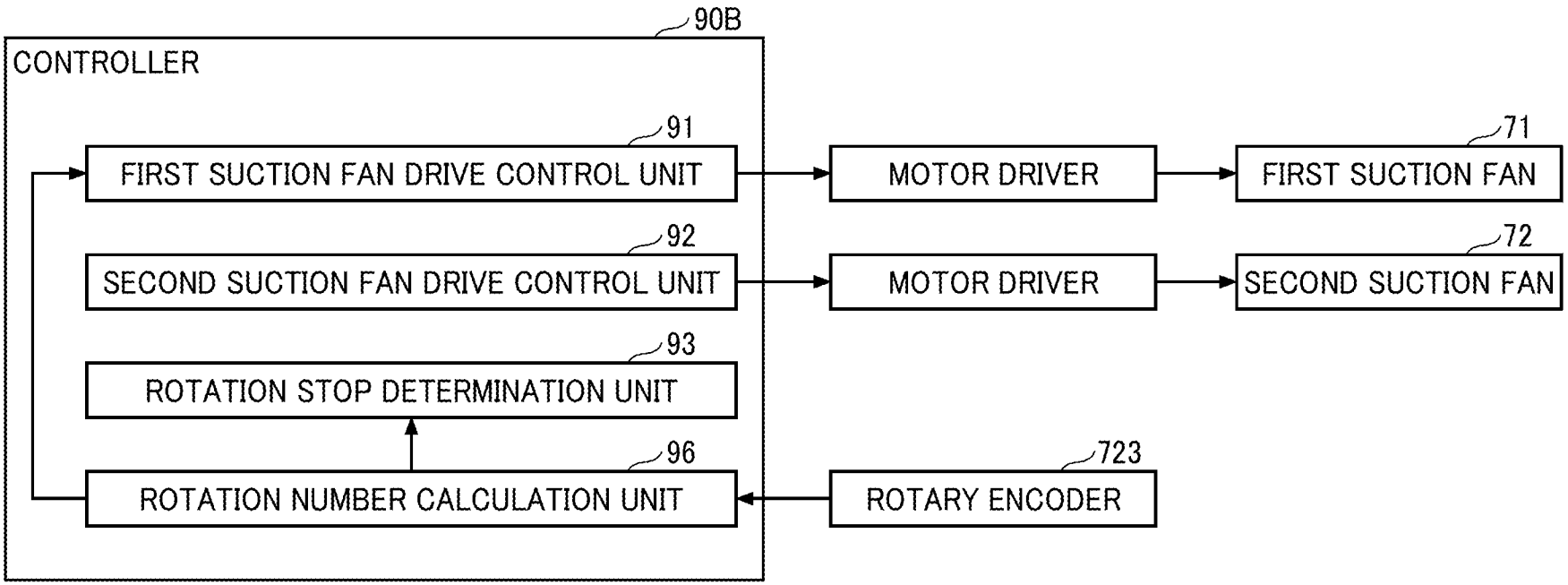
FIG. 15 is a block diagram illustrating a functional configuration of the controller according to Modification 2 of the first embodiment of the present disclosure.

Now, a description is given of a functional configuration of a controller 90B according to Modification 2 of the first embodiment, with reference to FIG. 15.

FIG. 15 is a block diagram illustrating a functional configuration of the controller 90B according to Modification 2 of the first embodiment of the present disclosure.

As illustrated in FIG. 15, the controller 90B further includes a rotation number calculation unit 96 that acquires an output signal from the rotary encoder 723 and calculates, for example, the number of rotations of the rotor blade 721 of the second suction fan 72. Further, the rotation number calculation unit 96 outputs the calculation result related to the number of rotations of the rotor blade 721 to the first suction fan drive control unit 91. The function of the rotation number calculation unit 96 is implemented by executing the predetermined program by, for example, the CPU 241.

In a case where, after the second suction fan 72 starts the stopping operation, the number of rotations of the rotor blade 721 of the second suction fan 72 calculated by the rotation number calculation unit 96 is equal to or greater than the given threshold, the rotation number calculation unit 96 outputs a control signal to increase the number of rotations of the rotor blade 711 of the first suction fan 71, to the first suction fan drive control unit 91. In accordance with this operation by the rotation number calculation unit 96, the first suction fan drive control unit 91 outputs a control signal to increase the number of rotations of the rotor blade 711 of the first suction fan 71 from the number of rotations of the rotor blade 711 in the normal control period, to the motor driver of the first suction fan 71. As a result, the air blow amount from the first suction fan 71 to the second suction fan 72 increases, so that the greater force can be applied with respect to the rotor blade 721 of the second suction fan 72 in the direction opposite to the direction of inertial rotation.

Subsequently, in a case where the number of rotations of the rotor blade 721 by inertial rotation decreases and the number of rotations of the rotor blade 721 calculated by the rotation number calculation unit 96 is smaller than the given threshold, the rotation number calculation unit 96 outputs a control signal to decrease the number of rotations of the rotor blade 711 of the first suction fan 71, to the first suction fan drive control unit 91. In accordance with this operation by the rotation number calculation unit 96, the first suction fan drive control unit 91 outputs a control signal to decrease the number of rotations of the rotor blade 711 of the first suction fan 71, to the motor driver of the first suction fan 71.

As a result, the air blow amount from the first suction fan 71 to the second suction fan 72 can be adjusted in accordance with the rotation force of the rotor blade 721 of the second suction fan 72.

The controller 90B detects the number of rotations of the rotor blade 721 of the second suction fan 72 based on the output signal from the rotary encoder 723, and controls the number of rotations of the rotor blade 711 of the first suction fan 71 in accordance with the detected number of rotations of the rotor blade 721 of the second suction fan 72. As a result, not only the rotor blade 721 of the second suction fan 72 but also the rotor blade 711 of the first suction fan 71 can reduce the respective times to the complete stop.

Modification 3 of First Embodiment

Configuration

Figure 16:
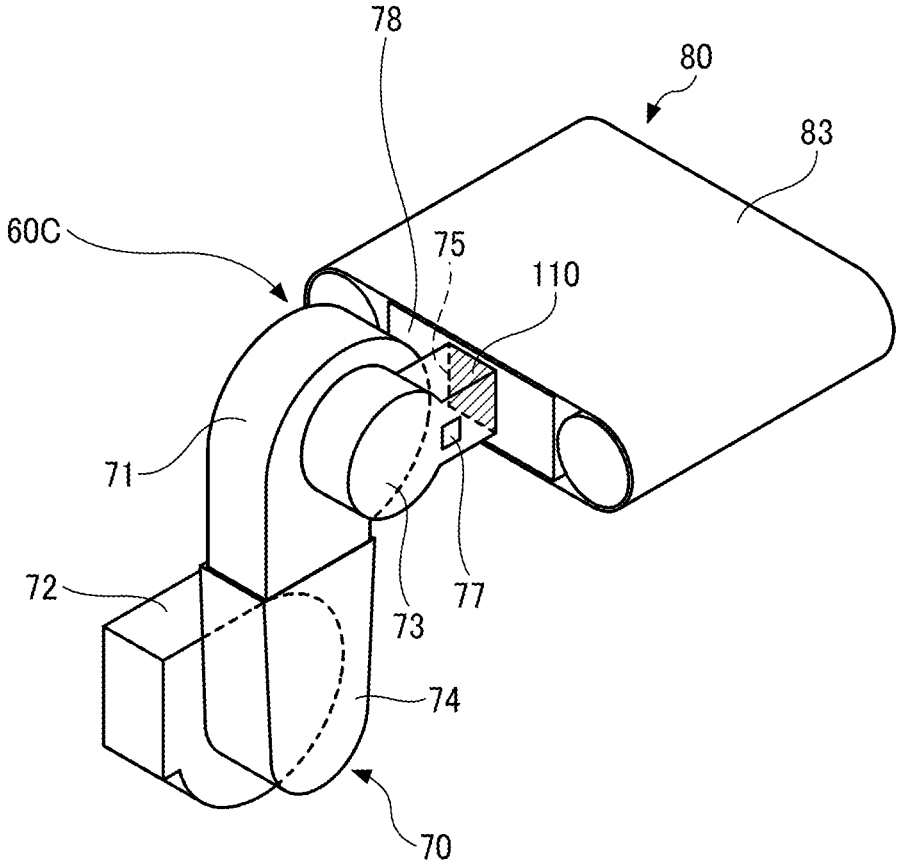
FIG. 16 is a perspective view of the suction mechanism according to Modification 3 of the first embodiment of the present disclosure.

A description is now given of a suction mechanism according to Modification 3 of the first embodiment, with reference to FIG. 16.

FIG. 16 is a perspective view of a suction mechanism 60C according to Modification 3 of the first embodiment of the present disclosure.

In the following description, components that are the same as or similar to the components in the first embodiment and Modifications 1 and 2 of the first embodiment may be denoted by the same reference numerals and the description may be omitted.

As illustrated in FIG. 16, the suction mechanism 60C according to Modification 3 further includes an air pressure sensor 77 to detect the air pressure in the fan unit 70. In Modification 3, the air pressure sensor 77 is disposed in the first duct 73. However, as long as the air pressure sensor 77 can detect the air pressure in the fan unit 70, the position of the air pressure sensor 77 is not limited to the above-described position.

Controller

Figure 17:
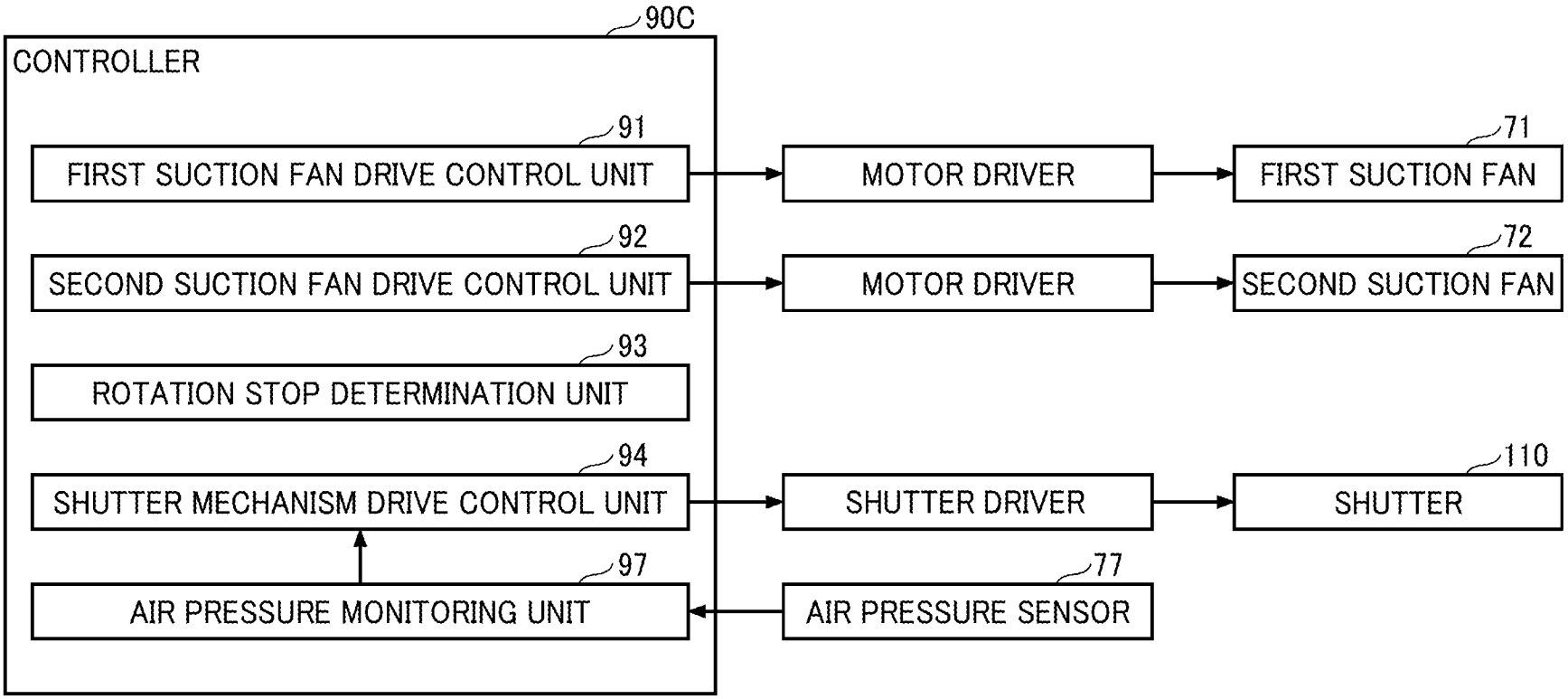
FIG. 17 is a block diagram illustrating a functional configuration of the controller according to Modification 3 of the first embodiment of the present disclosure.

A description is now given of a functional configuration of a controller 90C according to Modification 3 of the first embodiment, with reference to FIG. 17.

FIG. 17 is a block diagram illustrating a functional configuration of the controller 90C according to Modification 3 of the first embodiment of the present disclosure.

As illustrated in FIG. 17, the controller 90C according to Modification 3 includes an air pressure monitor 97. The air pressure monitor 97 receives an output signal from the air pressure sensor 77, and determines whether the air pressure in the fan unit 70 is below the given value (for example, outside pressure) during the stopping operations of the first suction fan 71 and the second suction fan 72.

In a case where the air pressure in the fan unit 70 is below the outside pressure, the air pressure monitor 97 outputs a control signal to the shutter mechanism drive control unit 94 so that the shutter 110 operates to close the suction port 75. Due to such a configuration, the shutter 110 closes the suction port 75, so that the first duct 73 and the suction chamber 78 are blocked from each other. As a result, this configuration can prevent a negative pressure in the suction chamber 78. In other words, after the first suction fan 71 and the second suction fan 72 start the stopping operations, the sheet is prevented from being sucked by the suction mechanism 60.

By contrast, in a case where the air pressure in the fan unit 70 is equal to or greater than the outside pressure, the air pressure monitor 97 outputs a control signal to the shutter mechanism drive control unit 94 so that the shutter 110 operates to open the suction port 75. Due to such a configuration, the first duct 73 and the suction chamber 78 communicate with each other again.

Although the drive device, the drive method, and the program according to the embodiments have been described above, this disclosure is not limited to the above-described embodiments, and various modifications and improvements are possible within the scope of the present disclosure.

For example, respective air blowing units included in the front air blower 51 and the side air blower 52 may also include a fan unit such as the fan unit 70 included in, for example, the suction mechanism 60. In other words, at least one of the front air blower 51 or the side air blower 52 may include two or more blower fans coupled to each other. Further, these blower fans may be coupled to each other via the duct.

Various operations (e.g., rotation driving, rotation stopping operation) of each blower fan included in at least one of the front air blower 51 or the side air blower 52 may be controlled by, for example, the above-described controller 90. For example, the controller 90A may unlock the sheet tray 40 in accordance with a stop of the rotor blades of each blower fan included in at least one of the front air blower 51 or the side air blower 52. Further, the number of rotations of a rotor blade of the blower fan may be detected by the rotation number detector such as a rotary encoder. The controller 90B may determine the stop of rotations of the blower fan based on the detection result of the number of rotations of a rotary encoder.

A description is now given of some aspects of the present disclosure.

Aspect 1

In Aspect 1, a sheet feeding device includes an air blower including multiple blower (suction) fans aligned in a serial manner, and circuitry to control operations of the multiple blower fans of the air blower, the circuitry is to stop the operations of the multiple blower fans at respective timings.

Aspect 2

In Aspect 2, in the sheet feeding device according to Aspect 1, each of the multiple blower fans has a rotor blade, the air blower rotates the rotor blade of each of the multiple blower fans, the multiple blower fans include a first blower fan and a second blower fan that stops at a stop timing earlier than a stop timing at the first blower fan, and the circuitry is to cause a number of rotations of the rotor blade of the first blower fan to be different in a period other than a period in which a stop of an operation of the first blower fan is controlled.

Aspect 3

In Aspect 3, the sheet feeding device according to Aspect 1 or 2 further includes a shutter to open or close an air passage, wherein the circuitry is to close the shutter to stop air blow by the air blower when an operation of at least a blower fan of the multiple blower fans is stopped.

Aspect 4

In Aspect 4, in the sheet feeding device according to Aspect 3, the circuitry is to cause a part of the air passage to be closed to adjust an amount of air blow of the air blower.

Aspect 5

In Aspect 5, in the sheet feeding device according to Aspect 3 or 4, each of the multiple blower fans has a rotor blade, and the circuitry is to open the shutter after a complete stop of the rotor blade of the blower fan.

Aspect 6

In Aspect 6, the sheet feeding device according to any one of Aspects 3 to 5 further includes a tray to stack the sheet, wherein the circuitry is to unlock the tray after the shutter is closed while a rotor blade of the blower fan is rotating.

Aspect 7

In Aspect 7, in the sheet feeding device according to any one of Aspects 3 to 6, the air blower includes an air pressure sensor to detect a pressure within the air blower, and the circuitry is to cause the shutter to open or close based on an output signal from the air pressure sensor.

Aspect 8

In Aspect 8, in the sheet feeding device according to any one of Aspects 1 to 7, the multiple blower fans include a first blower fan and a second blower fan having a stop timing earlier than a stop timing of the first blower fan, each of the multiple blower fans has a rotor blade, the air blower includes a rotation number detector to detect a number of rotations of the rotor blade of at least the second blower fan, and the circuitry is to control a number of rotations of the rotor blade of the first blower fan to move a complete stop of the first blower fan and the second blower fan forward, based on an output signal from the rotation number detector.

Aspect 9

In Aspect 9, an image forming apparatus includes the sheet feeding device according to any one of Aspects 1 to 8.

Aspect 10

In Aspect 1, a sheet feeding device includes an air blower (for example, the air blower 60) and circuitry (for example, the controller 90). The air blower includes a first suction fan (for example, the first suction fan 71), and a second suction fan (for example, the second suction fan 72) serially coupled to the first suction fan. The circuitry is to stop the first suction fan at a first timing, and stop the second suction fan at a second timing different from the first timing.

Aspect 11

In Aspect 11, in the sheet feeding device according to Aspect 10, the first suction fan includes a first rotor blade, and the second suction fan includes a second rotor blade. The second timing is earlier than the first timing. The circuitry is further to cause the first rotor blade and the second rotor blade to rotate, cause the first rotor blade to rotate at a first number of rotations per unit time during a first period, cause the first rotor blade to rotate at a second number of rotations per unit time larger than the first number of rotations per unit time during a second period other than the first period, and cause the second suction fan to stop at the second timing during the second period.

Aspect 12

In Aspect 12, the sheet feeding device according to Aspect 10 or 11 further includes a conveyor to convey a sheet, an air passage connecting the air blower and the conveyor, and a shutter (for example, the shutter mechanism 100) to openably close the air passage. The circuitry is further to close the shutter during the second period.

Aspect 13

In Aspect 13, in the sheet feeding device according to Aspect 12, the circuitry is to cause the shutter to partly close the air passage to adjust an amount of air suctioned from the conveyor to the air blower.

Aspect 14

In Aspect 14, in the sheet feeding device according to Aspect 12 or 13, the circuitry is further to open the shutter after the first rotor blade and the second rotor blade completely stop.

Aspect 15

In Aspect 15, the sheet feeding device according to any one of Aspects 12 to 14 further includes a tray (for example, the sheet tray 40) to stack the sheet, and a lock (for example, the lock mechanism 98) to lock a drawing operation of the tray. The circuitry is further to unlock the tray after the shutter is closed while at least one of the first rotor blade or the second rotor blade is rotating.

Aspect 16

In Aspect 16, in the sheet feeding device according to any one of Aspects 12 to 15, the air blower includes an air pressure sensor (for example, the air pressure sensor 77) to detect a pressure within the air blower and output an output signal based on the pressure detected, and the circuitry is further to operate the shutter based on the output signal from the air pressure sensor.

Aspect 17

In Aspect 17, in the sheet feeding device according to any one of Aspects 10 to 16, the first suction fan includes a first rotor blade, and the second suction fan includes a second rotor blade. The second timing is earlier than the first timing. The air blower further includes a rotation number detector (for example, the rotary encoder 723) to detect a first number of rotations per unit time of the first rotor blade and a second number of rotations per unit time of the second rotor blade and output an output signal. The circuitry is further to cause the first rotor blade to rotate at a first number of rotations per unit time, cause the second rotor blade to rotate at a second number of rotations per unit time, and control the first number of rotations per unit time of the first rotor blade to hasten a complete stop of the first suction fan and the second suction fan based on the output signal from the rotation number detector.

Aspect 18

In Aspect 18, an image forming apparatus includes the sheet feeding device according to any one of Aspects 10 to 17.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet feeding device comprising:

an air blower including:

a first suction fan including a first rotor blade; and a second suction fan including a second rotor blade, the second suction fan serially coupled to the first suction fan, and circuitry configured to:

stop the first suction fan at a first timing;

stop the second suction fan at a second timing earlier than the first timing;

cause the first rotor blade and the second rotor blade to rotate;

cause the first rotor blade to rotate at a first number of rotations per unit time during a first period;

cause the first rotor blade to rotate at a second number of rotations per unit time larger than the first number of rotations per unit time during a second period other than the first period; and cause the second suction fan to stop at the second timing during the second period.

2. The sheet feeding device according to claim 1, further comprising:

a conveyor including a pair of rollers configured to convey a sheet;

an air passage connecting the air blower and the conveyor; and a shutter configured to openably close the air passage, wherein the circuitry is further configured to close the shutter during the second period.

3. The sheet feeding device according to claim 2, wherein the circuitry is configured to cause the shutter to partly close the air passage to adjust an amount of air suctioned from the conveyor to the air blower.

4. The sheet feeding device according to claim 2, wherein the circuitry is further configured to open the shutter after the first rotor blade and the second rotor blade completely stop.

5. The sheet feeding device according to claim 2, further comprising:

a tray configured to stack the sheet; and a lock configured to lock a drawing operation of the tray, wherein the circuitry is further configured to unlock the tray after the shutter is closed while at least one of the first rotor blade or the second rotor blade is rotating.

6. The sheet feeding device according to claim 2, wherein the air blower includes an air pressure sensor configured to detect a pressure within the air blower and output an output signal based on the pressure detected, and the circuitry is further configured to operate the shutter based on the output signal from the air pressure sensor.

7. The sheet feeding device according to claim 1, wherein the air blower further includes a rotation number detector configured to detect a number of rotations per unit time of the first rotor blade and the second rotor blade, and output an output signal, and the circuitry is further configured to control the first number of rotations per unit time of the first rotor blade to hasten a complete stop of the first suction fan and the second suction fan based on the output signal from the rotation number detector.

8. An image forming apparatus comprising the sheet feeding device according to claim 1.

* * * * *